US005133280A

United States Patent [19]

Kubo

[11] Patent Number: 5,133,280

[45] Date of Patent: Jul. 28, 1992

[54] LIQUID FLOW CONTROL DEVICE IN BOWLING LANE MAINTENANCE SYSTEM

[76] Inventor: Chikanari Kubo, 7-2-101, Araisono 4-chome, Sagamihara City, Kanagawa Pref., Japan

[21] Appl. No.: 596,565

[22] Filed: Oct. 11, 1990

Related U.S. Application Data

[63] Continuation of Ser. No. 405,056, Sep. 7, 1989, abandoned, which is a continuation of Ser. No. 262,325, Oct. 25, 1988, abandoned.

[30] Foreign Application Priority Data

Mar. 7, 1988 [JP] Japan ..... 63-174159

[51] Int. Cl.[5] ..... B05C 1/08

[52] U.S. Cl. ..... 118/259; 137/209; 137/624.13; 401/219

[58] Field of Search ..... 137/209, 624.13; 134/172; 15/320, 321, 98; 239/99; 118/260, 258, 259, 108, 109, 207; 401/219

[56] References Cited

U.S. PATENT DOCUMENTS

| | | | |
|---|---|---|---|
| 3,330,070 | 7/1967 | Ferm | 239/99 X |
| 3,711,891 | 1/1973 | Conway | 15/322 X |
| 3,751,755 | 8/1973 | Smith | 137/209 X |
| 3,808,631 | 5/1974 | Shibata | 15/322 X |
| 4,079,694 | 3/1978 | Galinou | 118/207 |
| 4,124,315 | 11/1978 | Melton | 15/98 X |
| 4,708,603 | 11/1987 | Kubo | 417/415 |
| 4,727,615 | 3/1988 | Kubo | 15/98 |
| 4,738,000 | 4/1988 | Kubo | 15/98 |
| 4,776,016 | 8/1988 | Kubo | 427/428 |

*Primary Examiner*—Alan Cohan

*Attorney, Agent, or Firm*—Andrus, Sceales, Starke & Sawall

[57] ABSTRACT

The present invention provides an apparatus for controlling the flow of a liquid supplied to a system applying a liquid to a substantially flat surface, the apparatus including a source of pressurized air, an enclosed tank containing a predetermined amount of liquid and connecting with the source of pressurized air through an air line, a pressure reducing valve arranged in the air line and adapted to control the pressure of air to be fed into the enclosed tank, a nozzle connecting with the liquid outlet of the enclosed tank through a liquid supply line and also coupling with the liquid applying system, a two-way valve disposed in the liquid supply line between the enclosed tank and the nozzle and adapted to intermittently blocking the flow of the liquid in the liquid supply line, and a restrictor disposed in the liquid supply line downstream of the two-way valve.

1 Claim, 2 Drawing Sheets

LIQUID FLOW CONTROL DEVICE IN BOWLING LANE MAINTENANCE SYSTEM

This is a continuation of application Ser. No. 07/405,056, filed Sept. 7, 1989, which is a continuation of application Ser. No. 07/262,325, filed Oct. 25, 1987, both now abandoned.

BACKGROUND OF THE INVENTION

1. Field of the Invention:

The present invention relates to an apparatus for applying oil or liquid cleaner to a flat surface and more particular to an improved apparatus of controlling the amount of the oil or liquid cleaner to be supplied to bowling lane maintenance machines or oil or cleaner applying machines in floor cleaning systems.

2. Description of the Prior Art:

The applicant has proposed a liquid flow controlling device in Japanese patent application 60-77026, in which a fixed displacement pump for pumping oil is digitally controlled to determine the amount of oil to be supplied precisely. However, such a digital controller is complicated in construction and expensive in manufacturing cost. Furthermore, such an arrangement is desirable to be of a construction simplified as far as possible in consideration with disassembling or maintenance, because the oil or cleaner handled by the fixed displacement pump contains various chemicals such as nuetralizing agent or others and particularly in respect to the cleaner, it may incude sediments.

SUMMARY OF THE INVENTION

It is therefore an object of the present invention to provide a liquid flow controlling device of a very simple and unexpensive construction having substantially no movable part and which can perform the control of the liquid flow in a very easy manner.

To this end, the present invention provides an apparatus for controlling the flow of a liquid supplied to a system applying a liquid to a substantially flat surface, said apparatus comprising a source of pressurized air, an enclosed tank containing a predetermined amount of liuqid and connecting with said source of pressurized air through an air line, a pressure reducing valve arranged in said air line and adapted to control the pressure of air to be fed into said enclosed tank, nozzle means connecting with the liquid outlet of said enclosed tank through a liquid supply line and also coupling with said liquid applying system, a two-way valve disposed in said liquid supply line between said enclosed tank and said nozzle means and adapted to intermittently blocking the flow of the liquid in said liquid supply line, and restricting means disposed in said liquid supply line downstream of said two-way valve.

DETAILED DESCRIPTION OF PREFERRED EMBODIMENTS

Figure 1:
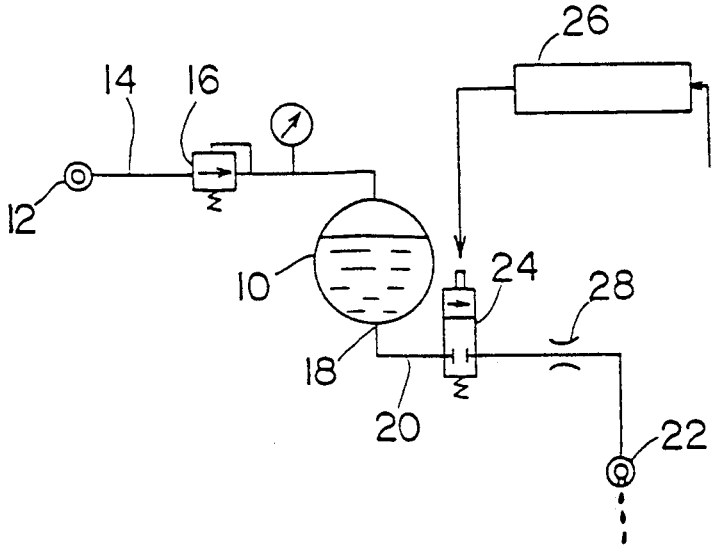
FIG. 1 is a block diagram illustrating the principle of a liquid flow controlling apparatus constructed in accordance with the present invention.

Referring first to FIG. 1, there is shown the principle of the present invention. In accordance with the present invention, a liquid flow controlling apparatus comprises an enclosed tank 10 containing a predetermined volume of oil or liquid cleaner and connected with a source of pressurized air 12 through an air line 14. The air line includes a pressure reducing valve 16 disposed therein, which valve 16 is adapted to maintain the pressure within the enclosed tank 10 constant. The pressure within the enclosed tank 10 serves to move the liquid outwardly therefrom through a liquid outlet 18.

The liquid outlet 18 of the enclosed tank 10 is connected with a nozzle 22 through a liquid supply line 20. The nozzle 22 in turn is connected with an oil or cleaner applying device in a bowling lane maintenance machine which will be described later.

Figure 2:
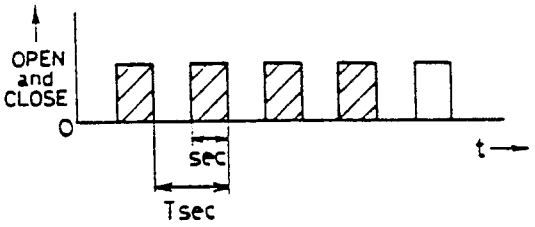
FIG. 2 illustrates the timing of control in the liquid flow controlling apparatus shown in FIG. 1.

The liquid supply line 20 includes a two-way valve 24 disposed therein, which valve 24 is adapted to intermittently block the flow of the liquid passing through the liquid supply line 20 from the enclosed tank 10 so as to control the amount of the liquid to be discharged outwardly through the nozzle 22. The two-way valve 24 is opened only for t seconds at a predetermined period T, as seen from FIG. 2. By changing such a term of opening, the amount of the liquid discharged from the nozzle means can be regulated properly. The two-way valve 24 may be controlled pneumatically or electromagnetically.

The liquid supply line 20 also includes restricting means 28 disposed therein, which restricting means 28 serves to provide a resistance of flow higher than that of the nozzle 22 on discharging to ensure that the pressure in the enclosed tank 10 is maintained at a higher level to perform the forced discharge of the liquid.

In such an arrangement, the pressure reducing valve 16 is first regulated to select a pressure level. This regulation is then combined with the control of the opening and closing in the two-way valve 24 such that the liquid can be forcedly discharged from the enclosed tank 10 through the nozzle 22 with the amount of the discharged liquid being optionally regulated.

Figure 3:
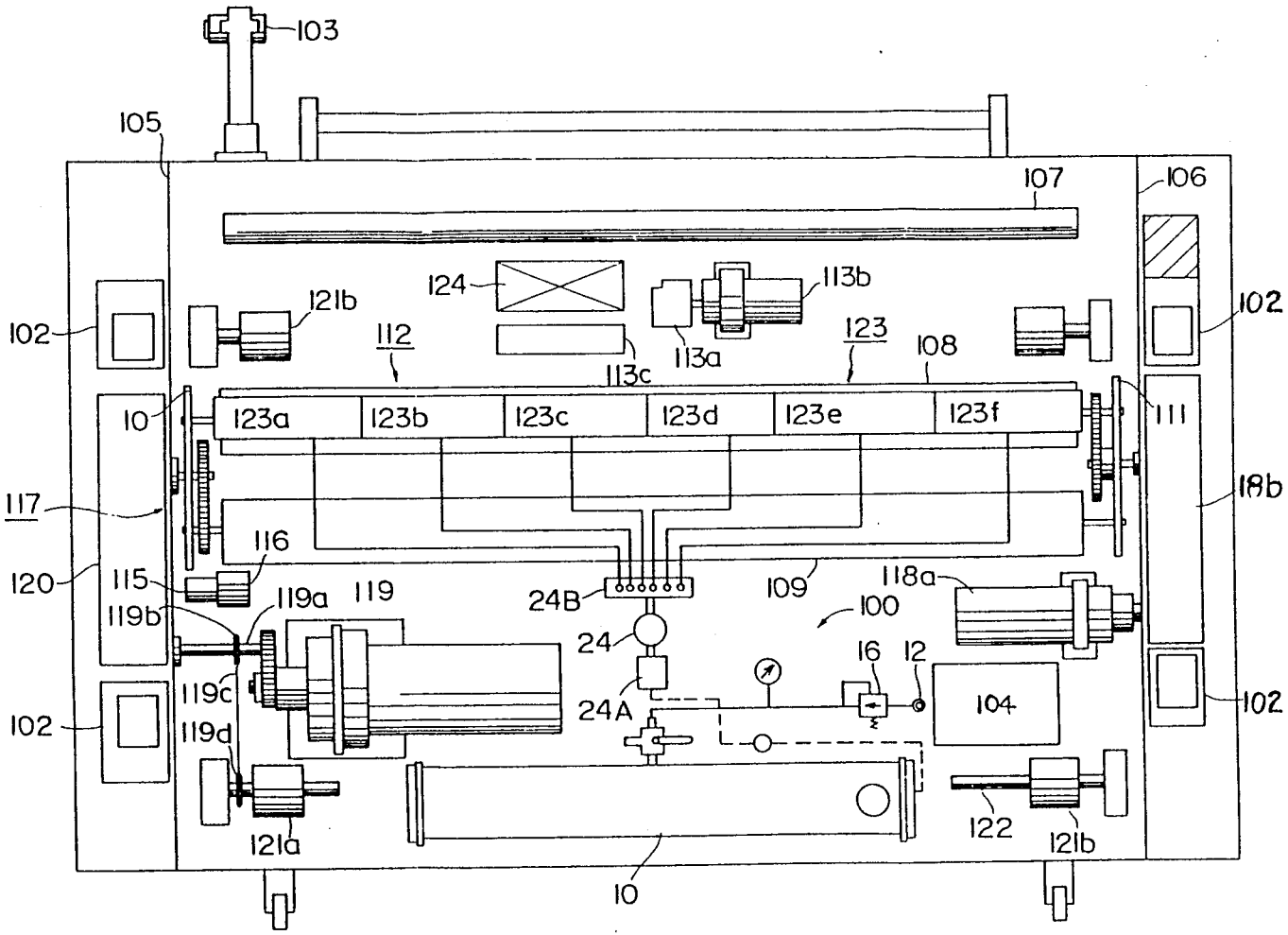
FIG. 3 is a plan view showing a bowling lane maintenance machine into which the liquid flow controlling apparatus of the present invention is incorporated.

Referring now to FIG. 3, there is shown a bowling lane maintenance machine into which a liquid flow controlling apparatus of the present invention is incorporated. This bowling lane maintenance machine is of substantially the same construction as disclosed in said Japanese Patent Application No. 60-77026 and therefore will be described briefly with respect to its construction.

The body 101 of the bowling lane maintenance machine is moved on the top face of a bowling lane along the length thereof while cleaning the top lane face and then applying a conditioning oil thereto. After completion of the cleaning and/or oil applying of that bowling lane, the machine body 101 is automatically transversely moved onto the next adjacent bowling lane to perform the same conditioning and maintaining operation. Such a continuous automated operation is controlled from an operation controller 104 in response to input signals from a distance integrating meter (not shown) for counting the distance of the running body 101, a transverse-motion sensor 103 and others. The body 101 is provided with a pair of side plates 105 and 106 disposed parallel to each other along the length of the machine. Between the side plates 105 and 106 there are arranged a cleaning unit 107, an oil or cleaner applying roller 108 and a buff roller 109 in a direction perpendicular to the planes including the side plates. The oil or cleaner applying roller 108 and the buff roller 109 are rotatably supported on side plates 110 and 111 parallel to these side plates. The side plates 110 and 111 in turn are rotatably supported by the side plates 105 and 106 parallel to the side plates 105 and 106. Thus, the rollers 108 and 109 define a roller unit 112. The roller unit 112 can selectively be set at various positions, that is, an oil or cleaner applying position, a neutral position and a buffing position under the action of a combination of the operation controller 104 with a swinging mechanism 117 which consists of a compressor 113*a*, a compressor driving motor 113*b*, a compressed air tank 113*c* and air cylinders 115 and 116.

The oil or cleaner applying roller 108 is rotatably driven from a drive motor 118*a* through a power transmitting mechanism 118*b* which is disposed outside the side plate 106. On the other hand, the buff roller 109 is rotatably driven from a drive motor 119 through a power transmitting mechanism 120 which is arranged outside the side plate 105. The drive motor 119 has its output shaft 119*a* which is operatively coupled with a drive axle 122 on a driving wheel 121*a* in the machine body 101 through a chain 119*c* passed around sprockets 119*b* and 119*d*. Thus, a pair of driven wheels 121*b* in the body 101 will be driven to move the body 101 forwardly or rearwardly along the top face of the lane.

Above the oil or cleaner applying roller 108 there is disposed an oil or cleaner supplying unit 123 for providing a conditioning oil or cleaner to the oil or cleaner applying roller 108. The oil or cleaner supplying unit 123 receives a predetermined volume of oil or cleaner from an oil or cleaner tank 10 through a liquid flow controlling apparatus 100 according to the present invention. More particularly, the oil or cleaner supplying unit 123 is divided into six blocks 123*a*, 123*b*, 123*c*, 123*d*, 123*e* nd 123*f* which are arranged in a longitudinal direction, that is, in a direction perpendicular to the central line of the bowling lane. There is no liquid communication between each adjacent blocks.

Figure 4:
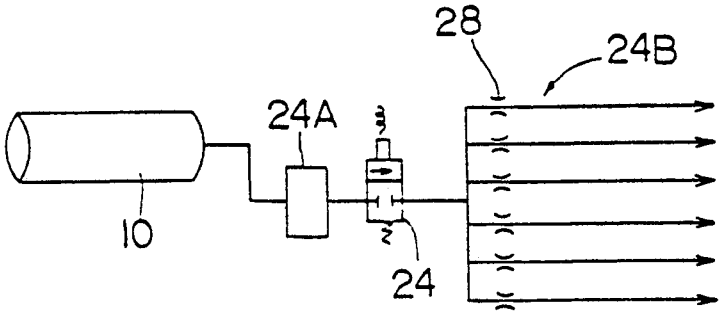
FIG. 4 is a view illustrating the downstream-side details of the two-way valve in the liquid flow controlling apparatus shown in FIG. 3.

The liquid flow controlling apparatus 100 incorporated into the bowling lane maintenance machine shown in FIG. 3 is of substantially the same construction as that of the apparatus shown in FIG. 1. Therefore, similar parts are designated by similar reference numerals. In the arrangement of FIG. 3, however, a filter 24A is disposed upstream the two-way valve 24 while a branch block 24B is arranged downstream the same two-way valve 24. The branch block 24B includes a plurality of branched lines each of which communicates with the corresponding one of the blocks 123*a*, 123*b*, 123*c*, 123*d*, 123*e* and 123*f* in the cleaner applying roller 108, as shown in FIG. 4. Each of the branched lines includes restricting means 28 disposed therein.

In accordance with the above mentioned arrangement, the amount of oil or cleaner to be discharged through the nozzle can be controlled in an extremely simple and easy manner. This is very advantageous in repair or maintenance.

I claim:

1. A system for applying liquid to a substantially flat surface, comprising:

a rotatable roller engageable with said surface; means for moving said roller on said surface; and means for supplying liquid directly onto a surface of said roller for application to said substantialy flat surface by said roller, comprising:

a source of pressurized air;

an enclosed tank containing a predetermined amount of liquid and connecting with said source of pressurized air through an air line, said tank including a liquid outlet;

a pressure reducing valve arranged in said air line and being adapted to control the pressure of air to be fed into said enclosed tank through said air line;

a liquid supplying unit interconnected with the liquid outlet or said tank, said liquid supplying unit being disposed adjacent said roller and comprising a plurality of adjacent side-by-side blocks arranged along a longitudinal axis, with each block supplying liquid to a portion of said roller, said blocks being contiguous to each other and extending throughout the entire length of said roller;

nozzle outlet means interconnected with the liquid outlet of said tank by means of a plurality of liquid supply lines, each supply line communicating with one of said blocks for supplying liquid to said plurality of blocks, said nozzle outlet means providing a first resistance to fluid flow from said tank;

restricting means disposed in each said liquid supply line, said rstricting means providing a second resistance to fluid flow from said tank higher than said first resistance;

a selectively actuable two-way valve disposed upstream of said plurality of liquid supply lines between said nozzle outlet means and said enclosed tank; and a controller for automaticaly intermittently actuating said two-way valve to control the period of opening of said two-way valve to selectively intermittently provide flow of liquid through said one or more liquid supply lines to said nozzle outlet means.

* * * * *

UNITED STATES PATENT AND TRADEMARK OFFICE

CERTIFICATE OF CORRECTION

PATENT NO. : 5,133,280

DATED : July 28, 1992

INVENTOR(S) : CHIKANARI KUBO

It is certified that error appears in the above-identified patent and that said Letters Patent is hereby corrected as shown below:

CLAIM 1, Col. 4, Line 15, delete "substantialy" and substitute therefor -- substantially --; CLAIM 1, Col. 4, Line 26, delete "or" and substitute therefor -- of --; CLAIM 1, Col. 4, Line 40, delete "rstricting" and substitute therefor -- restricting --; CLAIM 1, Col. 4, Line 47, delete "automaticaly" and substitute therefor -- automatically --.

Signed and Sealed this

Tenth Day of August, 1993

*Attest:*

*Attesting Officer*

Michael K. Kirk

MICHAEL K. KIRK

*Acting Commissioner of Patents and Trademarks*